US010358834B2

(12) United States Patent
Hulett et al.

(10) Patent No.: US 10,358,834 B2
(45) Date of Patent: Jul. 23, 2019

(54) SCAFFOLD BRACKET

(71) Applicant: Apache Industrial Services, Inc., Houston, TX (US)

(72) Inventors: Burt Hulett, League City, TX (US); David Bretherton, Humble, TX (US)

(73) Assignee: Apache Industrial Services, Inc., Houston, TX (US)

( * ) Notice: Subject to any disclaimer, the term of this patent is extended or adjusted under 35 U.S.C. 154(b) by 70 days.

(21) Appl. No.: 15/406,478

(22) Filed: Jan. 13, 2017

(65) Prior Publication Data

US 2017/0130469 A1 May 11, 2017

Related U.S. Application Data

(62) Division of application No. 14/051,286, filed on Oct. 10, 2013, now Pat. No. 9,574,357.

(60) Provisional application No. 61/825,323, filed on May 20, 2013.

(51) Int. Cl.

| | |
|---|---|
| ***E04G 5/06*** | (2006.01) |
| ***E04G 3/20*** | (2006.01) |
| ***E04G 7/32*** | (2006.01) |
| ***E04G 5/04*** | (2006.01) |
| ***E04G 5/14*** | (2006.01) |

(52) U.S. Cl.

CPC ..... *E04G 5/062* (2013.01); *E04G 3/20* (2013.01); *E04G 5/046* (2013.01); *E04G 5/14* (2013.01); *E04G 7/32* (2013.01); *Y10T 29/49826* (2015.01)

(58) Field of Classification Search

CPC ..... E04G 5/062; E04G 5/06; E04G 5/061

See application file for complete search history.

(56) References Cited

U.S. PATENT DOCUMENTS

| | | | | |
|---|---|---|---|---|
| 3,403,751 | A | 10/1968 | Yoder | |
| 3,510,097 | A | 5/1970 | McCaleb | |
| 3,515,244 | A | 6/1970 | Weible | |
| 3,992,118 | A | 11/1976 | Siegers | |
| 4,039,264 | A | 8/1977 | Sharp | |
| 4,396,092 | A | 8/1983 | Thompson | |
| 4,493,578 | A | 1/1985 | D'Alessio | |
| 5,024,037 | A | 6/1991 | Ono | |
| 5,535,974 | A | 7/1996 | Savitski | |
| 5,560,730 | A * | 10/1996 | Gillard | E04G 1/02 182/186.7 |
| 5,865,410 | A | 2/1999 | Horen | |
| 5,961,240 | A | 10/1999 | Bobrovniczky | |
| 6,026,932 | A | 2/2000 | Comp | |
| 6,027,276 | A | 2/2000 | Schworer | |
| 6,722,471 | B2 | 4/2004 | Wolfe | |
| 7,258,197 | B1 | 8/2007 | Wicks | |
| D567,964 | S | 4/2008 | Lai | |
| 8,393,439 | B2 | 3/2013 | Thacker | |

(Continued)

*Primary Examiner* — Colleen M Chavchavadze

(74) *Attorney, Agent, or Firm* — Pramudji Law Group PLLC; Ari Pramudji

(57) ABSTRACT

Various implementations described herein are directed to a scaffold bracket. In one implementation, the scaffold bracket may include a mounting bracket having a first face and a second face opposite of the first face. The scaffold bracket may also include a first scaffolding node attached to the first face and configured to couple to a first member. The scaffold bracket may further include a second scaffolding node attached to the first face and configured to couple to a second member.

18 Claims, 9 Drawing Sheets

(56) References Cited

U.S. PATENT DOCUMENTS

| | | | |
|---|---|---|---|
| 2002/0027043 | A1 | 3/2002 | Wisler |
| 2006/0163001 | A1 | 7/2006 | Pozell |
| 2006/0243524 | A1 | 11/2006 | Jarrell |
| 2007/0056799 | A1 | 3/2007 | Leidner |

* cited by examiner

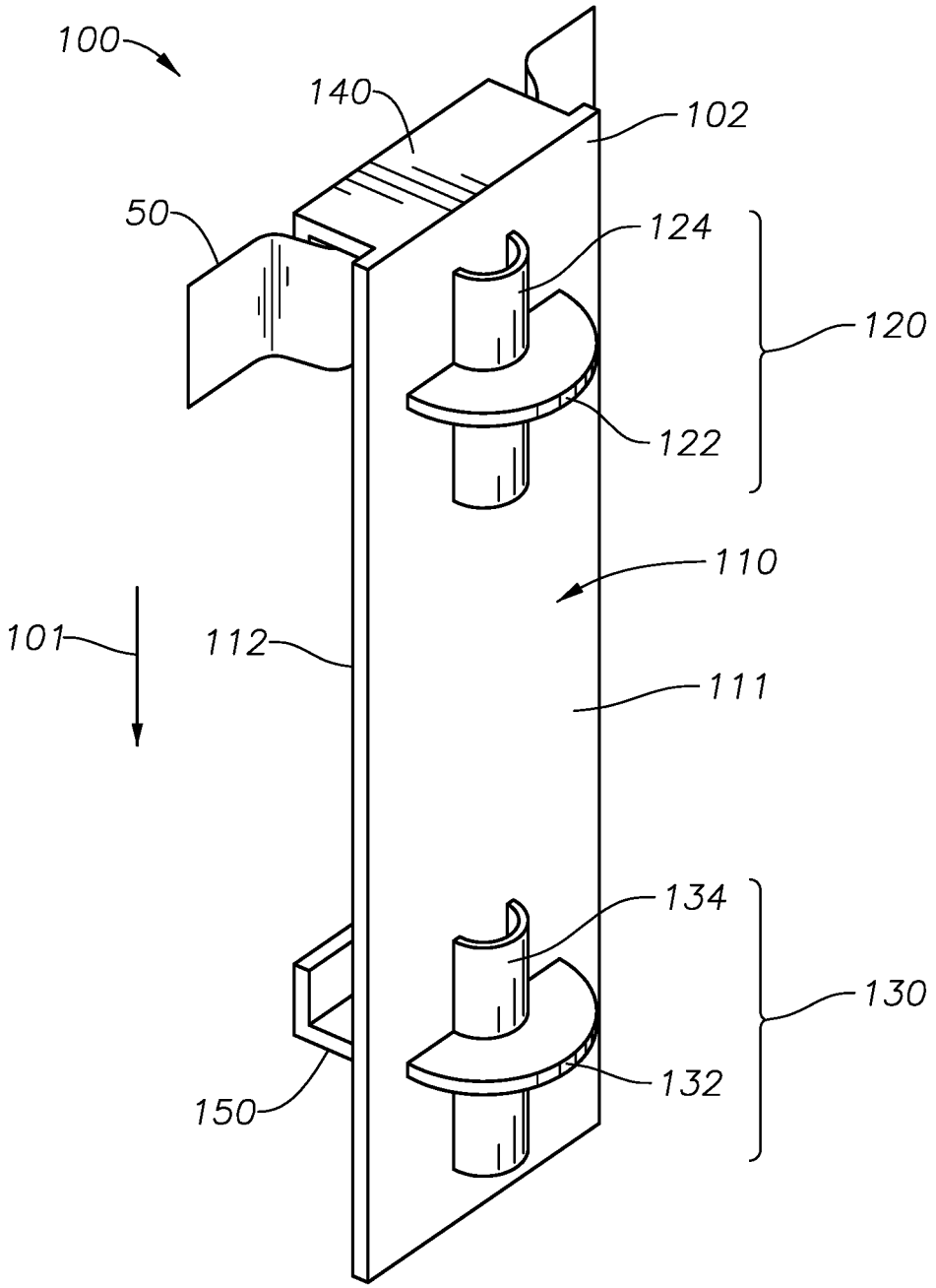
FIG. 1.1

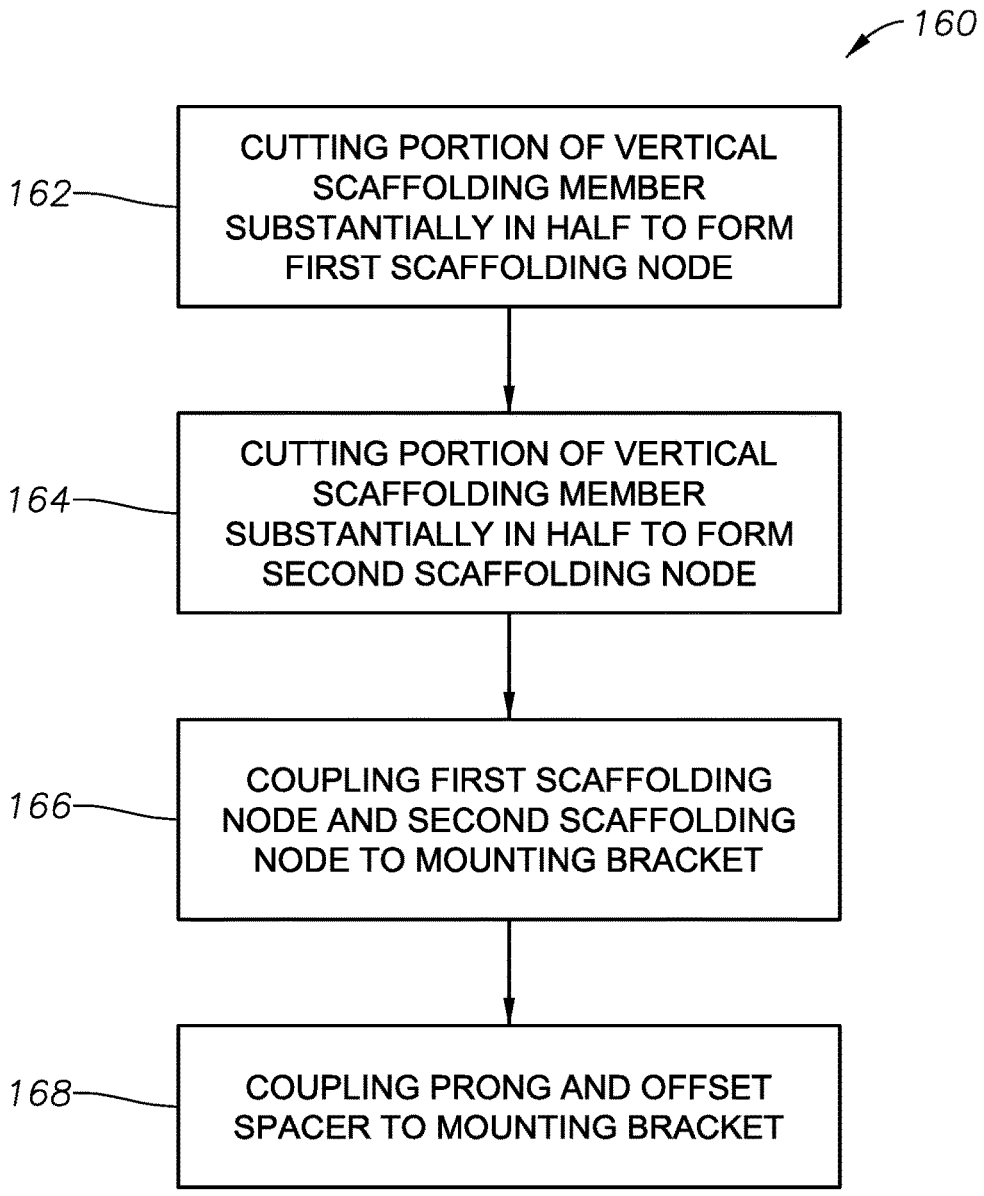
FIG. 1.2

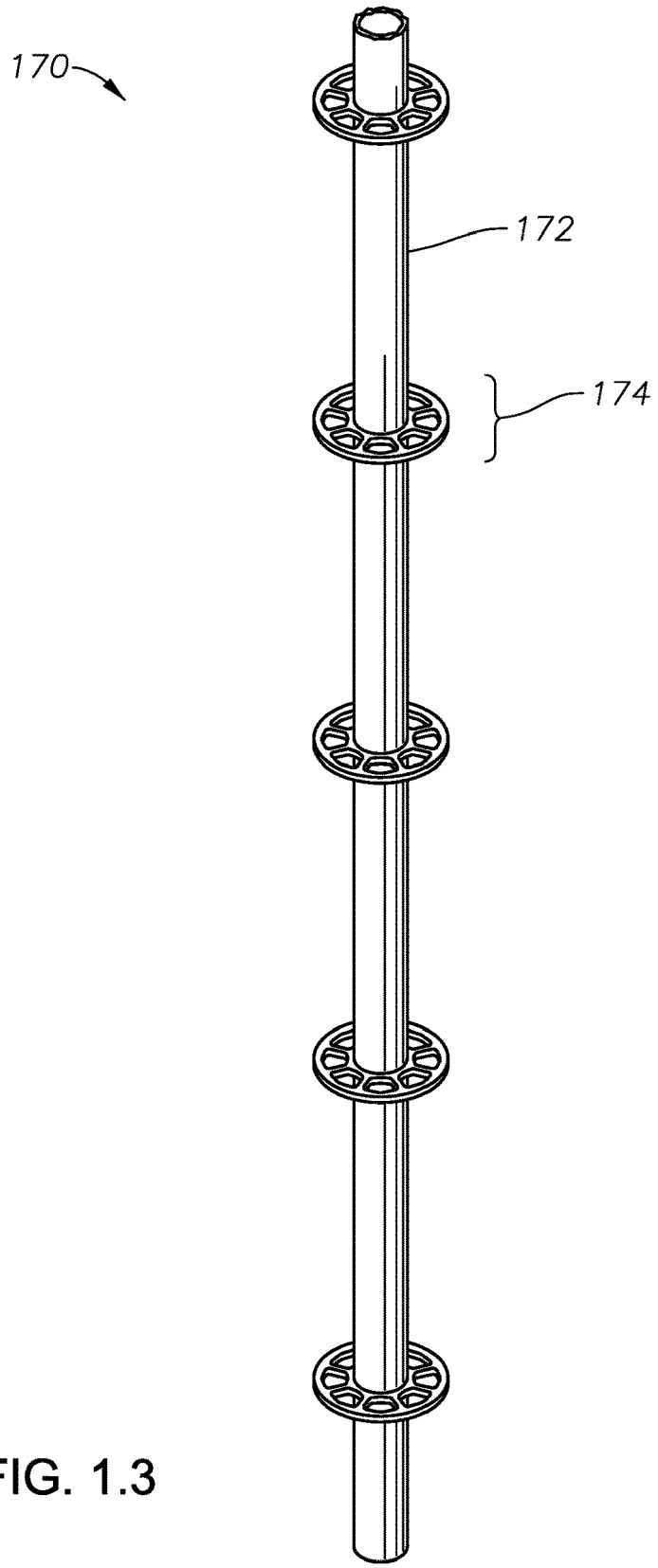
FIG. 1.3

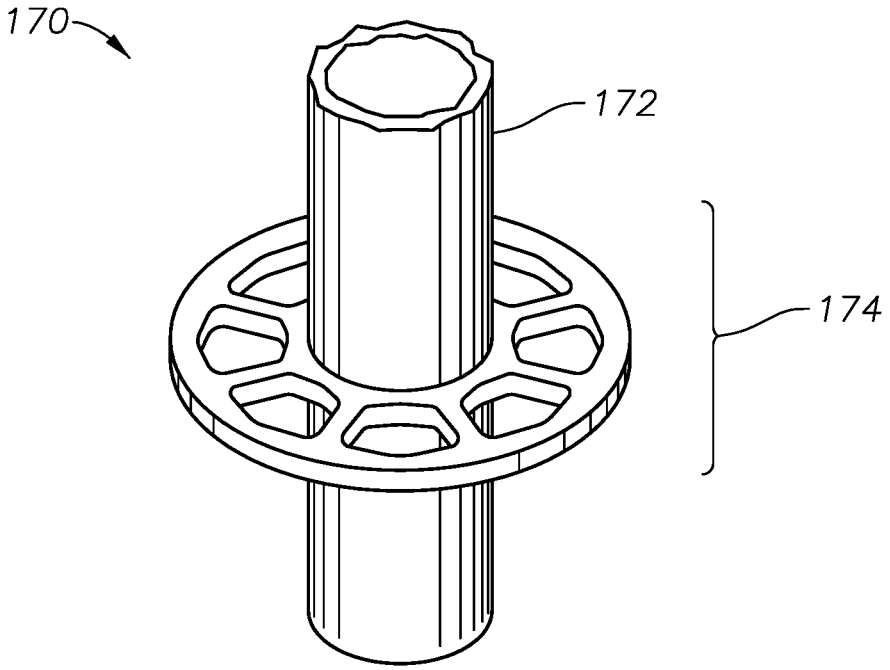
FIG. 1.4

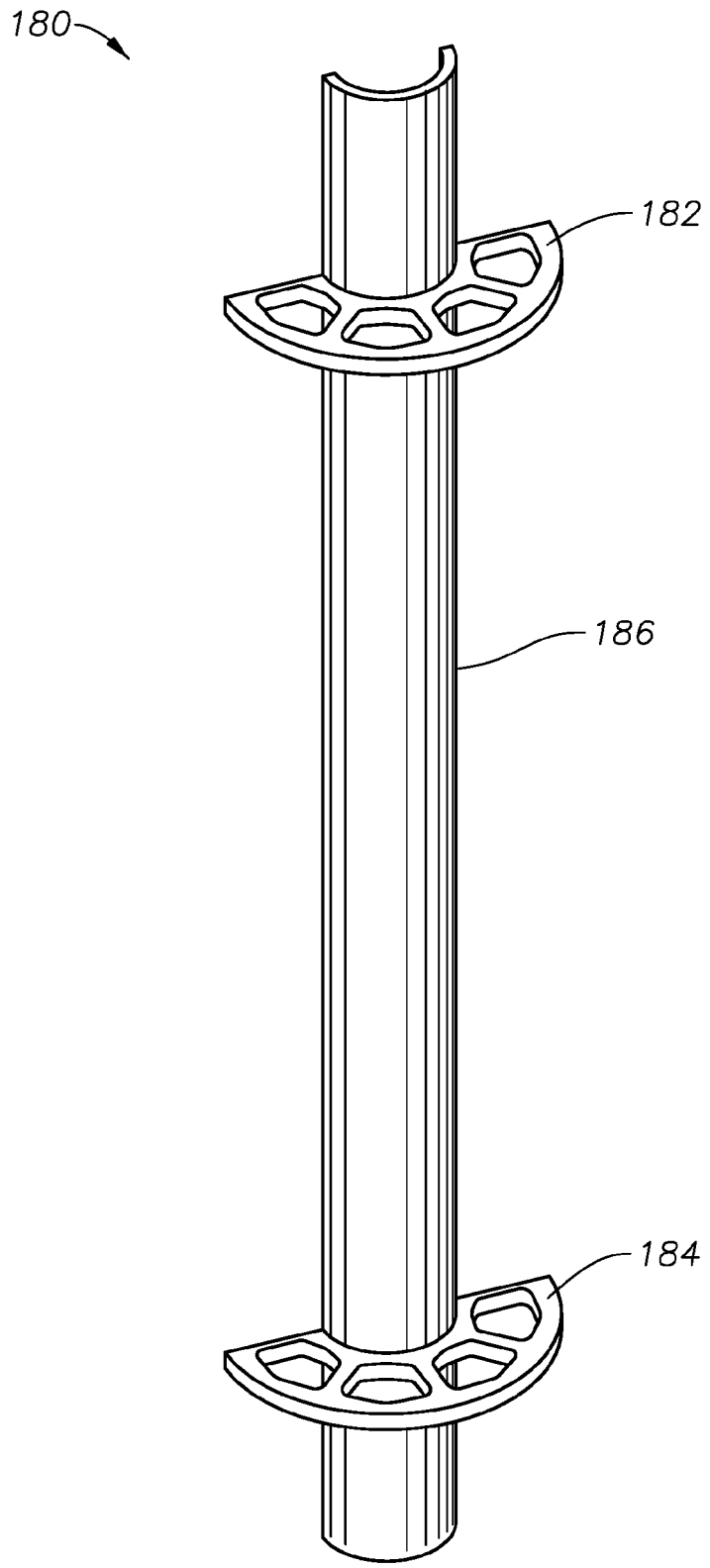
FIG. 1.5

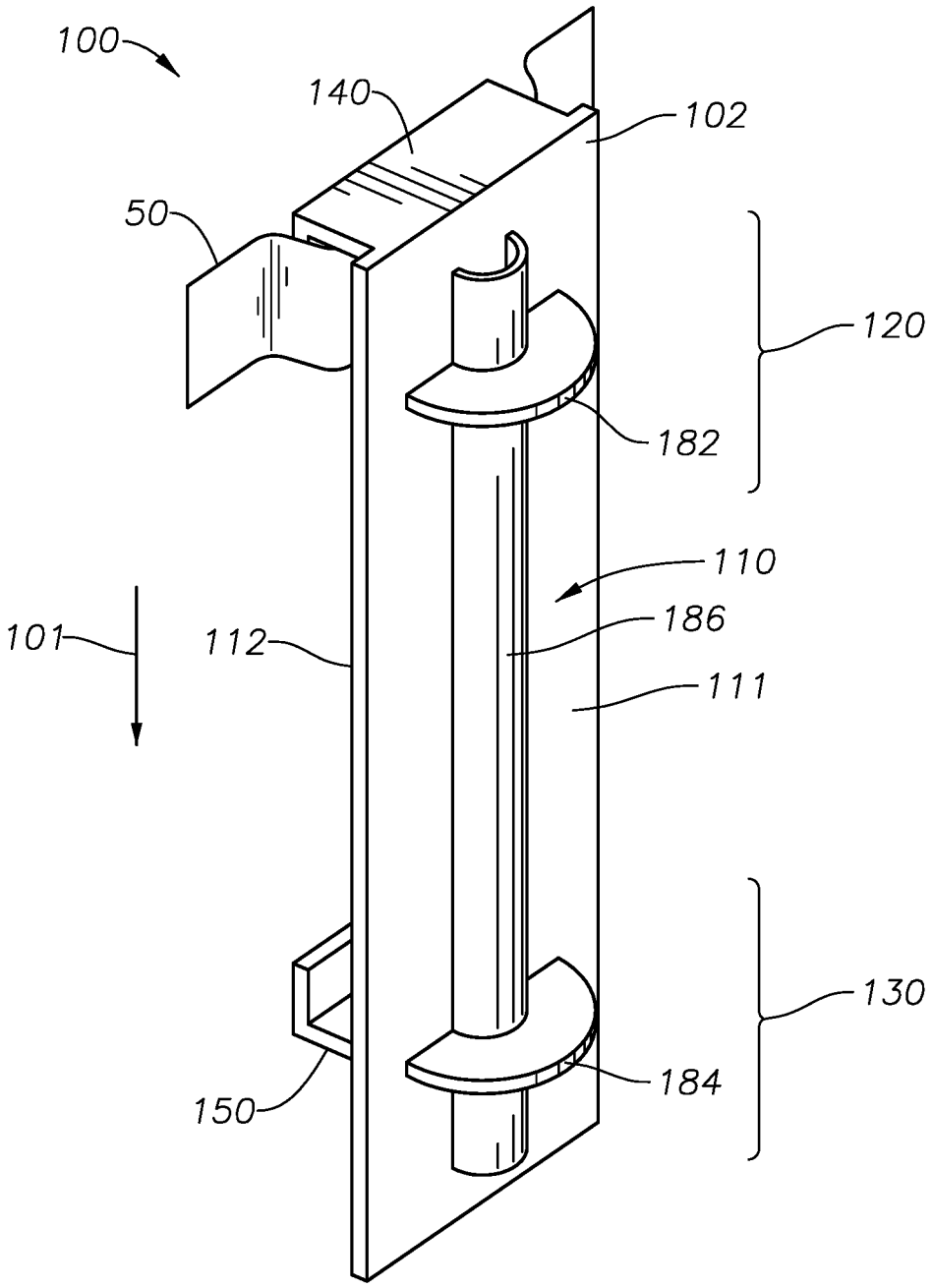
FIG. 1.6

SCAFFOLD BRACKET

CROSS-REFERENCE TO RELATED APPLICATIONS

This application is a divisional of co-pending U.S. patent application Ser. No. 14/051,286, filed Oct. 10, 2013, which claims benefit of U.S. provisional patent application Ser. No. 61/825,323, filed May 20, 2013. Each of the aforementioned related patent applications is herein incorporated by reference.

BACKGROUND

Field of the Invention

Implementations of various technologies described herein generally relate to a scaffold bracket.

Discussion of the Related Art

This section is intended to provide background information to facilitate a better understanding of various technologies described herein. As the section's title implies, this is a discussion of related art. That such art is related in no way implies that it is prior art. The related art may or may not be prior art. It should therefore be understood that the statements in this section are to be read in this light, and not as admissions of prior art.

During construction of a structure such as a building or a tank, a scaffolding system may be constructed which allows workers to operate on an elevated portion of the structure. In one scenario, the scaffolding system may be composed of a number of scaffolding components which are based on a ground surface and stacked on top of one another to build up the scaffolding system to a desired height. Components of the scaffolding system may include vertical members, horizontal members such as ledgers and guardrails, footings, decks or platforms, diagonal members, and scaffolding nodes for coupling two or more of the components of the scaffolding system to one another.

SUMMARY

Described herein are implementations of various technologies for a scaffold bracket. In one implementation, the scaffold bracket may include a mounting bracket having a first face and a second face opposite of the first face. The scaffold bracket may also include a first scaffolding node attached to the first face and configured to couple to a first member. The scaffold bracket may further include a second scaffolding node attached to the first face and configured to couple to a second member.

Described herein are implementations of various technologies for an apparatus, which may include a scaffold bracket. The scaffold bracket may include a mounting bracket having a first face and a second face opposite the first face. The scaffold bracket may also include a first scaffolding node attached to the first face and a second scaffolding node attached to the first face. The apparatus may also include a horizontal member coupled to the first scaffolding node. The apparatus may further include a diagonal member coupled to the second scaffolding node, where the horizontal member and the diagonal member are connected to one another at a node point.

Described herein are implementations of various technologies for a scaffolding system, which may include a plurality of scaffold brackets. Each scaffold bracket in the plurality of scaffold brackets may include a mounting bracket having a first face and a second face opposite the first face. Each scaffold bracket may also include a first scaffolding node attached to the first face and a second scaffolding node attached to the first face. The scaffolding system may also include a plurality of horizontal members, where each horizontal member is coupled to the first scaffolding node. The scaffolding system may further include a plurality of diagonal members, where each diagonal member is coupled to the second scaffolding node and to each horizontal member at a node point. The scaffolding system may additionally include a plurality of upright rails, each coupled to a node point, where the upright rails extend in an upward direction above the plurality of horizontal members and the plurality of diagonal members. In addition, the scaffolding system may include one or more horizontal rails coupled between the plurality of upright rails in a substantially horizontal direction.

Described herein are implementations of various technologies for a method for constructing a scaffold bracket, which may include cutting a portion of a first vertical scaffolding member substantially in half to form a first scaffolding node. The method may also include cutting a portion of a second vertical scaffolding member substantially in half to form a second scaffolding node. The method may further include coupling the first scaffolding node and the second scaffolding node to a first face of a mounting bracket. The method may additionally include coupling a prong and an offset spacer to a second face of the mounting bracket opposite the first face.

The above referenced summary section is provided to introduce a selection of concepts in a simplified form that are further described below in the detailed description section. The summary is not intended to be used to limit the scope of the claimed subject matter. Furthermore, the claimed subject matter is not limited to implementations that solve disadvantages noted in any part of this disclosure.

BRIEF DESCRIPTION OF THE DRAWINGS

Implementations of various techniques will hereafter be described with reference to the accompanying drawings. It should be understood, however, that the accompanying drawings illustrate various implementations described herein and are not meant to limit the scope of various techniques described herein.

FIG. 1.1 illustrates a view of a scaffold bracket for use with a scaffolding system in accordance with implementations of various techniques described herein.

FIG. 1.2 illustrates a flow diagram of a method for constructing a scaffold bracket in accordance with implementations of various technologies and techniques described herein.

FIG. 1.3 illustrates a vertical scaffolding member in connection with implementations of various techniques described herein.

FIG. 1.4 illustrates a portion of a vertical scaffolding member in connection with implementations of various techniques described herein.

FIG. 1.5 illustrates a portion of a vertical scaffolding member in connection with implementations of various techniques described herein.

FIG. 1.6 illustrates a view of a scaffold bracket for use with a scaffolding system in accordance with implementations of various techniques described herein.

DETAILED DESCRIPTION

Figure 2:
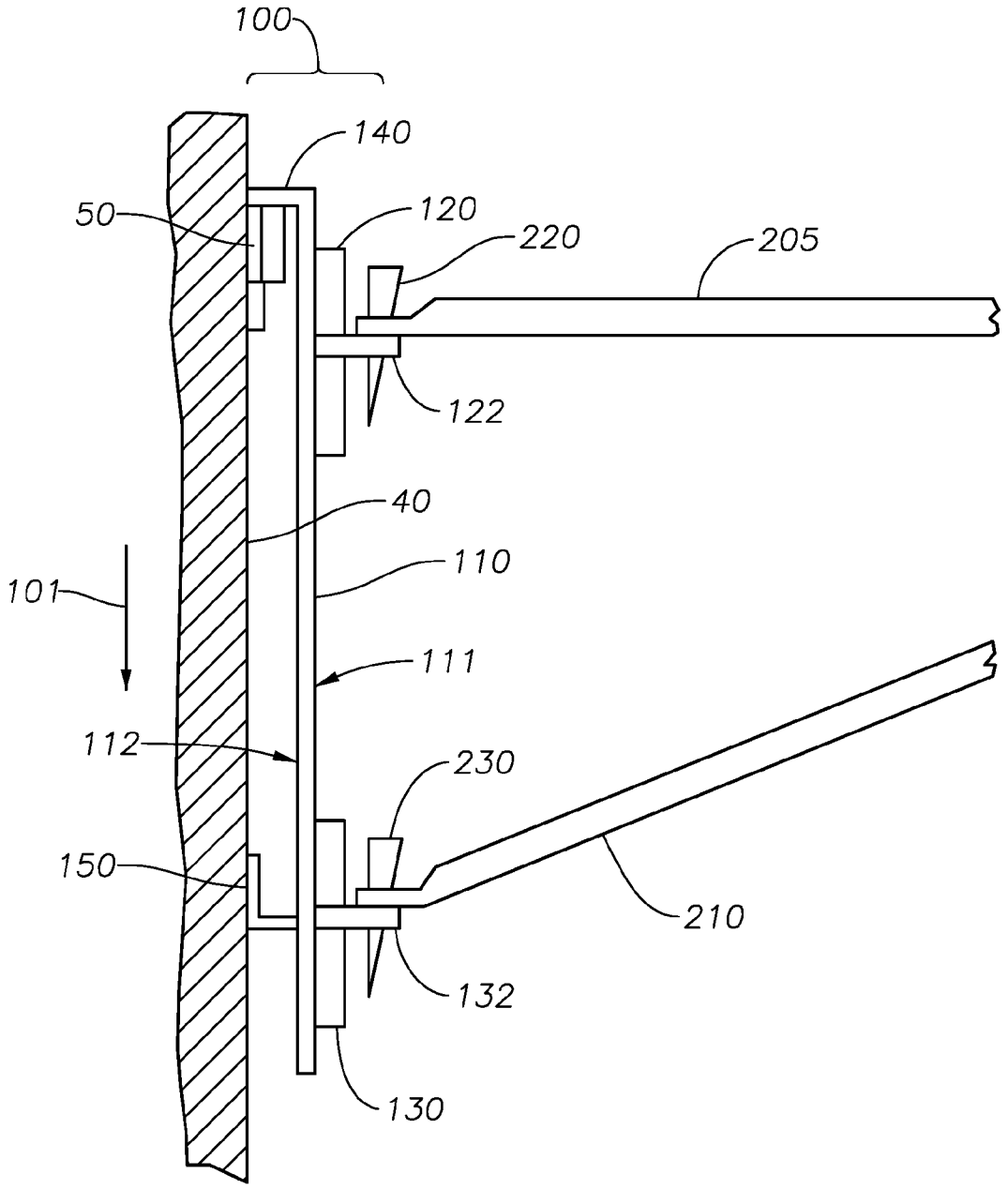
FIG. 2 illustrates a view of the scaffold bracket used with a scaffolding system in accordance with implementations of various techniques described herein.

The discussion below is directed to certain specific implementations. It is to be understood that the discussion below is for the purpose of enabling a person with ordinary skill in the art to make and use any subject matter defined now or later by the patent "claims" found in any issued patent herein.

It is specifically intended that the claims not be limited to the implementations and illustrations contained herein, but include modified forms of those implementations including portions of the implementations and combinations of elements of different implementations as come within the scope of the following claims.

Reference will now be made in detail to various implementations, examples of which are illustrated in the accompanying drawings and figures. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, and components have not been described in detail so as not to obscure aspects of the embodiments.

It will also be understood that, although the terms first, second, etc. may be used herein to describe various elements, these elements should not be limited by these terms. These terms are used to distinguish one element from another. For example, a first object could be termed a second object, and, similarly, a second object could be termed a first object, without departing from the scope of the claims. The first object and the second object are both objects, respectively, but they are not to be considered the same object.

The terminology used in the description of the present disclosure herein is for the purpose of describing particular implementations and is not intended to be limiting of the present disclosure. As used in the description of the present disclosure and the appended claims, the singular forms "a," "an" and "the" are intended to include the plural forms as well, unless the context clearly indicates otherwise. It will also be understood that the term "and/or" as used herein refers to and encompasses one or more possible combinations of one or more of the associated listed items. It will be further understood that the terms "includes" and/or "including," when used in this specification, specify the presence of stated features, integers, operations, elements, and/or components, but do not preclude the presence or addition of one or more other features, integers, operations, elements, components and/or groups thereof.

As used herein, the terms "up" and "down"; "upper" and "lower"; "upwardly" and downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

It should also be noted that in the development of any such actual implementation, numerous decisions specific to circumstance may be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The terminology and phraseology used herein is solely used for descriptive purposes and should not be construed as limiting in scope. Language such as "having," "containing," or "involving," and variations thereof, is intended to be broad and encompass the subject matter listed thereafter, equivalents, and additional subject matter not recited.

Furthermore, the description and examples are presented solely for the purpose of illustrating the different embodiments, and should not be construed as a limitation to the scope and applicability. While any composition or structure may be described herein as having certain materials, it should be understood that the composition could optionally include two or more different materials. In addition, the composition or structure may also include some components other than the ones already cited. It should also be understood that throughout this specification, when a range is described as being useful, or suitable, or the like, it is intended that any value within the range, including the end points, is to be considered as having been stated. Furthermore, respective numerical values should be read once as modified by the term "about" (unless already expressly so modified) and then read again as not to be so modified unless otherwise stated in context. For example, "a range of from 1 to 10" is to be read as indicating a respective possible number along the continuum between about 1 and about 10. In other words, when a certain range is expressed, even if a few specific data points are explicitly identified or referred to within the range, or even when no data points are referred to within the range, it is to be understood that the inventors appreciate and understand that any data points within the range are to be considered to have been specified, and that the inventors have possession of the entire range and points within the range.

The following paragraphs provide a brief summary of various technologies and techniques directed at a scaffold bracket described herein.

In one implementation, the scaffold bracket may be configured to couple to a sheer wall of a structure, such as a storage tank, above ground storage tank, vessel, or any other steel, metal, or weld-capable structure known to those skilled in the art. The scaffold bracket may include a mounting bracket, a first scaffolding node, a second scaffolding node, a prong, and an offset spacer. The first scaffolding node and the second scaffolding node may be attached to a first face of the mounting bracket, and the prong and the offset spacer may be attached to a second face of the mounting bracket.

The scaffold bracket may couple to a wall bracket of the sheer wall via the prong. The offset spacer may contact the sheer wall, and may be used in conjunction with the prong to space the mounting bracket substantially equidistantly from the sheer wall. The first scaffolding node may be configured to couple to a first member of the scaffolding system, and the second scaffolding node may be configured to couple to a second member of the scaffolding system. The first scaffolding node and the second scaffolding node may each be a portion of a pin lock or any other coupling means known to those skilled in the art, where the portion may include a substantially semicircular rosette portion coupled to a substantially semicircular, cylindrical tubing portion.

The scaffold bracket may be formed by cutting a portion of a vertical scaffolding member substantially in halves in a lengthwise direction to form the first scaffolding node and the second scaffolding node. The first scaffolding node and the second scaffolding node may then be coupled to the mounting bracket. A prong and an offset spacer may then be coupled to the mounting bracket.

In one implementation, the scaffold bracket may be used to form a knee-braced cantilevered support. Accordingly, a horizontal member may be coupled to the first scaffolding node via the rosette portion, and a diagonal member may be coupled to the second scaffolding node via the rosette portion. The horizontal member and/or the diagonal member may be engineered scaffolding members. In this manner, the scaffold bracket, the horizontal member, and the diagonal member may together form a knee-braced cantilevered support. The horizontal member and the diagonal member may be connected to one another at a node point. The node point may include a coupling means for coupling to other scaffolding components.

In another implementation, a scaffolding system may be formed using the scaffold bracket. The scaffolding system may include a plurality of scaffold brackets, where each scaffold bracket may be coupled to a horizontal member and a diagonal member, thereby forming a knee-braced cantilevered support. Each horizontal member may connect to a diagonal member at a node point, where the node point may include a means for coupling to an upright rail. The upright rail may be a vertical post having one or more coupling means positioned along the upright rail. Each combination of the scaffold bracket, the horizontal member, diagonal member, and the upright rail may be connected to at least one other such combination in the scaffolding system to allow workers to traverse along the wall. A handrail and/or a midrail may be connected between at least two upright rails. In addition, a deck may be placed on top of a plurality of horizontal members. The upright rail, the handrail, and/or the midrail may be engineered scaffolding members.

Various implementations described above will now be described in more detail with reference to FIGS. 1.1-4.

Scaffold Bracket

Configuration

FIG. 1.1 illustrates a view of a scaffold bracket 100 for use with a scaffolding system in accordance with implementations of various techniques described herein. The scaffold bracket 100 may be configured to couple to a sheer wall (shown in FIGS. 2-3) of a structure, such as a storage tank, above ground storage tank, vessel, or any other steel, metal, or weld-capable structure known to those skilled in the art.

The scaffold bracket 100 may include a mounting bracket 110, a first scaffolding node 120, a second scaffolding node 130, a prong 140, and an offset spacer 150. The mounting bracket 110, the first scaffolding node 120, the second scaffolding node 130, the prong 140, and/or the offset spacer 150 may be composed of carbon steel, stainless steel, hot-dip galvanized steel, aluminum, or any other material known to those skilled in the art.

The mounting bracket 110 may be a metallic plate which includes a first face 111 and a second face 112. The first face 111 and/or the second face 112 may be substantially flat. The first scaffolding node 120 and the second scaffolding node 130 may be attached to the first face 111, and the prong 140 and the offset spacer 150 may be attached to the second face 112, as described below. In one implementation, the first scaffolding node 120 and the second scaffolding node 130 may extend laterally from the first face 111, and the prong 140 and the offset spacer 150 may extend laterally from the second face 112. In a further implementation, the prong 140 may extend laterally from the second face 112 at a top end 102 of the mounting bracket 110.

In one implementation, the scaffold bracket 100 may couple to the sheer wall (shown in FIGS. 2-3) via a wall bracket 50. The wall bracket 50 may extend laterally from the sheer wall, where the wall bracket 50 may be attached to the sheer wall via welding or any other means known to those skilled in the art. The scaffold bracket 100 may couple to the wall bracket 50 via the prong 140. In such an implementation, the prong 140 may be a male connector and the wall bracket 50 may be a female connector designed to couple to one another via hooking, latching, attachment, or any other implementation known to those skilled in the art. Although the scaffold bracket 100 has been described as being coupled to the sheer wall via a wall bracket 50 and the prong 140, it should be understood however that the scaffold bracket 100 may be coupled to the sheer wall via any other coupling means commonly known by persons of ordinary skill in the art.

For example, as shown in FIG. 1.1, the wall bracket 50 may be a metallic plate formed into a U-shape and welded to the sheer wall, where the U-shape of the wall bracket 50 may form an opening for use in coupling to the prong 140. Further, the prong 140 may take the form of a hook and may be inserted into the wall bracket 50 through the opening formed by the U-shape of the wall bracket 50, thereby coupling the prong 140 to the wall bracket 50.

Once the prong 140 is coupled to the wall bracket 50, the scaffold bracket 100 may be disposed in a substantially vertical direction 101, with the first face 111 facing outwardly and away from the sheer wall. In addition, the offset spacer 150 may contact the sheer wall, and may be used in conjunction with the prong 140 to space the mounting bracket 110 substantially equidistantly from the sheer wall. In one implementation, the prong 140 and the offset spacer 150 together may position the mounting bracket 110 to be substantially perpendicular to a ground surface. In such an implementation, the prong 140 and the offset spacer 150 may extend laterally from mounting bracket 110 at a substantially identical length. The offset spacer 150 may take any shape or size needed to space the mounting bracket 110 in conjunction with the prong 140. In one implementation, the prong 140 and the offset spacer 150 may be substantially identical in size and shape, and may be arranged to mirror one another.

The first scaffolding node 120 may be configured to couple to a first member (not pictured) of the scaffolding system, and the second scaffolding node 130 may be configured to couple to a second member (not pictured) of the scaffolding system. The first scaffolding node 120 and/or the second scaffolding node 130 may be coupled to the first face 111 via welding or any other implementation known to those skilled in the art, as further described below. In one implementation, the first scaffolding node 120 and the second scaffolding node 130 may be substantially identical.

The first scaffolding node 120 and the second scaffolding node 130 may each be a portion of a pin lock or any other coupling means known to those skilled in the art. For example, as illustrated in FIG. 1.1, the first scaffolding node 120 may be a portion of a pin lock that includes a substantially semicircular rosette portion 122 coupled to a substantially semicircular, cylindrical tubing portion 124. The rosette portion 122 may be concentrically coupled to the cylindrical tubing portion 124, such that the cylindrical tubing portion 124 may be encircled by the rosette portion 122.

Similarly, the second scaffolding node 120 may be a portion of a pin lock that includes a substantially semicircular rosette portion 132 coupled to a substantially semicircular, cylindrical tubing portion 134. In addition, the rosette portion 132 may be concentrically coupled to the cylindrical tubing portion 134, such that the cylindrical tubing portion 134 may be encircled by the rosette portion 132. The rosette portions 122, 132 may be coupled to their respective cylindrical tubing portions 124, 134 via welding or any other implementation known to those skilled in the art, as further described below.

In one implementation, the rosette portions 122, 132 may include a plurality of radially-arranged cut-outs used for coupling to the first member and the second member respectively. The cut-outs may be of one or more shapes and/or of one or more sizes. In addition, the cut-outs may be arranged along the rosette portions 122, 132, such that components, e.g., the first member and the second member, coupled to the rosette portions can be placed at varying angles with respect to the mounting bracket 110, as described below.

Construction

FIG. 1.2 illustrates a flow diagram of a method 160 for constructing a scaffold bracket in accordance with implementations of various technologies and techniques described herein. It should be understood that while method 160 indicates a particular order of execution of operations, in some implementations, certain portions of the operations might be executed in a different order. The following description of method 160 is provided with reference to the scaffold bracket 100 of FIG. 1.1.

At block 162, the first scaffolding node 120 may be formed by cutting a portion of a vertical scaffolding member substantially in half in a lengthwise direction. The vertical scaffolding member may be a vertical post or any other implementation known to those skilled in the art. An example of a vertical scaffolding member 170 is shown in FIG. 1.3. In one implementation, the vertical scaffolding member 170 may be a cylindrical tube 172 having one or more rosettes 174, i.e., pin locks, positioned along the cylindrical tube 172. The rosettes 174 may encircle the cylindrical tube 172, and may be coupled to the cylindrical tube 172 via welding or any other means known to those skilled in the art. The portion of the vertical scaffolding member 170 to be cut substantially in half may include one rosette 174 and a portion of the cylindrical tube 172 extending from both a top and a bottom of the rosette 174, as shown in FIG. 1.4.

Once cut substantially in half, the first scaffolding node 120 may be formed, where the first scaffolding node 120 includes the substantially semicircular rosette portion 122 coupled to the substantially semicircular, cylindrical tubing portion 124, as shown in FIG. 1.1.

At block 164, the second scaffolding node 130 may be formed by cutting a portion of a vertical scaffolding member substantially in half in a lengthwise direction. In one implementation, the vertical scaffolding member of block 164 may be similar or identical to the vertical scaffolding member of block 162, such as the member 170 shown in FIG. 1.3. Similar to block 162, the portion of the vertical scaffolding member to be cut substantially in half may include one rosette and a portion of the cylindrical tube extending from both a top and a bottom of the rosette, as similarly shown in FIG. 1.4.

Once cut substantially in half, the second scaffolding node 130 may be formed, where the second scaffolding node 130 includes the substantially semicircular rosette portion 132 coupled to the substantially semicircular, cylindrical tubing portion 134, as shown in FIG. 1.1.

In another implementation, the same vertical scaffolding member may be used to form the first scaffolding node 120 and the second scaffolding node 130 of blocks 162 and 164. For example, a portion of a single vertical scaffolding member may be cut substantially in half, producing a first half and a second half. In such an example, the first half may be used to form the first scaffolding node 120, and the second half may be used to form the second scaffolding node 130. In a further implementation, a portion of the vertical scaffolding member 180 cut substantially in half may include a substantially semicircular first rosette portion 182, a substantially semicircular second rosette portion 184, and a substantially semicircular cylindrical tubing portion 186 extending between the two rosette portions, as shown in FIG. 1.5. In such an implementation, once cut substantially in half, the first scaffolding node 120 may be formed at the first rosette portion 182 and the second scaffolding node 130 may be formed at the second rosette portion 184, with the cylindrical tubing portion 186 coupled between the two nodes.

At block 166, the first scaffolding node 120 and the second scaffolding node 130 may be coupled to the mounting bracket 110. As described above, the scaffolding nodes 120, 130 may be coupled to the first face 111 via welding or any other implementation known to those skilled in the art. In one implementation, the first scaffolding node 120 and the second scaffolding node 130 may be positioned on the first face 111, such that the first scaffolding node 120 may be closer to the top end 102 of the mounting bracket 110. The second scaffolding node 130 may be placed proximately below the first scaffolding node in a substantially identical configuration. In a further implementation, the first scaffolding node 120 and the second scaffolding node 130 may be substantially vertically aligned to one another along the mounting bracket 110. In yet another implementation, the first scaffolding node 120 formed at the first rosette portion 182 and the second scaffolding node 130 formed at the second rosette portion 184 may be coupled to the mounting bracket 100 with the cylindrical tubing portion 186 coupled between the two nodes, as shown in FIG. 1.6.

At block 168, the prong 140 and the offset spacer 150 may be coupled to the mounting bracket 110. As described above, the prong 140 and the offset spacer 150 may extend laterally from the second face 112. In one implementation, the prong 140 and/or the offset spacer 150 may be coupled to the second face 112 via welding or any other implementation known to those skilled in the art. In another implementation, the prong 140 and/or the offset spacer 150 may be part of the metallic plate which forms the mounting bracket 110, as described above.

Scaffolding System

Upon coupling the scaffold bracket 100 to the sheer wall of a structure, scaffolding components may be coupled to the scaffold bracket 100 to create a scaffolding system. The scaffolding components may include engineered scaffolding members, as they are known to those skilled in the art. Engineered scaffolding members may be designed to withstand a particular stress and/or weight, i.e., they may have undergone destructive testing for quality control purposes.

In addition, engineered scaffolding members may be designed to conform to standards set forth by the Occupational Safety & Health Administration (OSHA). In one implementation, the engineered scaffolding members may be cylindrical tubes composed of carbon steel, stainless steel, hot-dip galvanized steel, aluminum, or any other material known to those skilled in the art.

FIG. 2 illustrates a view of the scaffold bracket 100 used with a scaffolding system in accordance with implementations of various techniques described herein. As shown in FIG. 2, the scaffold bracket 100 may be coupled to a wall 40 via the wall bracket 50 and the prong 140, as described above. The scaffold bracket 100 may be spaced substantially equidistantly from the wall 40 due to the positioning of the prong 140 and the offset spacer 150 on the second face 112.

In addition, horizontal member 205 may be coupled to the first scaffolding node 120 via the rosette portion 122. Similarly, the diagonal member 210 may be coupled to the second scaffolding node 130 via the rosette portion 132. In one implementation, the horizontal member 205 and/or the diagonal member 210 may be engineered scaffolding members as described above. The horizontal member 205 may be a horizontal brace or any other implementation known to those skilled in the art. The diagonal member 210 may be a diagonal brace or any other implementation known to those skilled in the art.

In one implementation, the horizontal member 205 may have an end with a slot used for coupling to the rosette portion 122. The slot of the horizontal member 205 may align with a cut-out of the rosette portion 122, allowing a wedge 220 to be disposed through the cut-out and the slot. Consequently, the horizontal member 205 and the rosette portion 122 may be coupled via frictional force. In one implementation, the wedge 220 may be hammered through the cut-out and the slot. In another implementation, the end having the slot may be pinched down relative to the rest of the horizontal member 205 in order to facilitate the use of the wedge 205 with the slot.

Similarly, the diagonal member 210 may have an end with a slot used for coupling to the rosette portion 132. A wedge 230 may be similarly used to couple the diagonal member 210 and the rosette portion 132 via frictional force. The end of the diagonal member 210 having the slot may also be similarly pinched down. In one implementation, the cut-outs may be arranged along the rosette portions 122, 132 such that horizontal member 205 and/or the diagonal member 210 can be placed at varying angles with respect to the mounting bracket 110. In another implementation, other coupling means known to those skilled in the art may be used in place of the wedge 220 and/or the wedge 230.

The scaffold bracket 100, the horizontal member 205, and the diagonal member 210 may together form a knee-braced cantilevered support. In one implementation, the horizontal member 205 and the diagonal member 210 may be coupled to each other via welding or any other coupling means known to those skilled in the art. In another implementation, the horizontal member 205 and the diagonal member 210 may be connected to one another at a node point (not shown). The node point may include a coupling means for coupling to other scaffolding components, as described below.

In one implementation, a plurality of scaffold brackets 100, horizontal members 205, and diagonal members 210 may be used with other scaffolding components to create a scaffolding system. Other scaffolding components may include engineered scaffolding members such as an upright rail 330, a handrail 310, and/or a midrail 320, as described with respect to FIG. 3.

Figure 3:
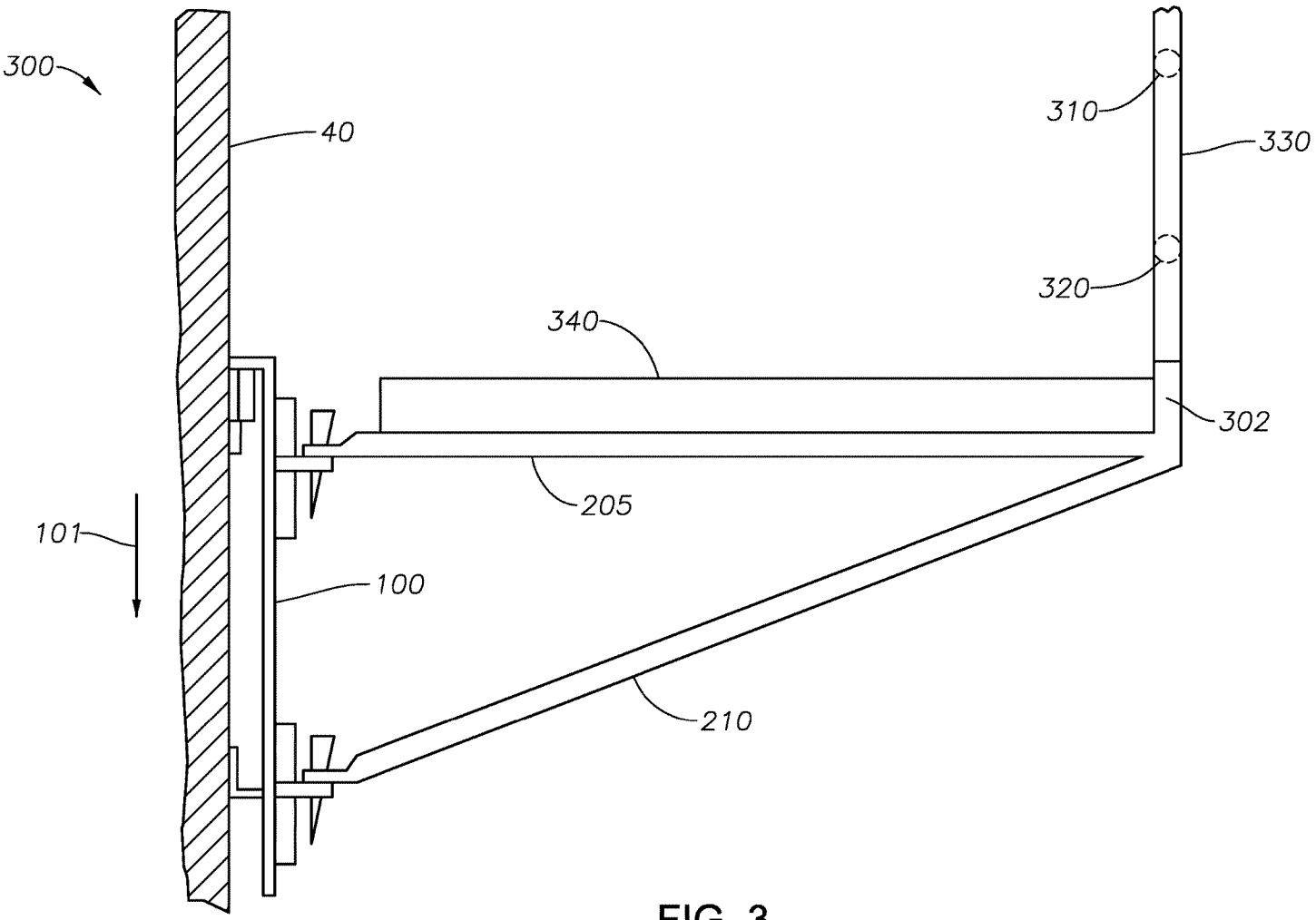
FIG. 3 illustrates a scaffolding system which uses a plurality of scaffold brackets in accordance with implementations of various techniques described herein.

FIG. 3 illustrates a scaffolding system 300 which uses a plurality of scaffold brackets 100 in accordance with implementations of various techniques described herein. As shown in FIG. 3, each scaffold bracket 100 may be coupled to the wall 40 via a wall bracket 50 (not shown) and a prong 140 (not shown), as described above. In addition, each scaffold bracket 100 may be coupled to a horizontal member 205 and a diagonal member 210, thereby forming a knee-braced cantilevered support.

Each horizontal member 205 may connect to a diagonal member 210 at a node point 302, where the node point 302 may include a means for coupling to an upright rail 330. In one implementation, the upright rail 330 may be inserted into the node point 302 and fastened using bolts or other implementations known to those skilled in the art. The upright rail 330 may vertically extend from the node point 302 in an upward direction. In another implementation, the upright rail 330 may be a vertical post having one or more coupling means positioned along the upright rail 330. The coupling means may include a rosette, i.e., a pin lock, or other coupling implementations known to those skilled in the art.

In one implementation, a handrail 310 and/or a midrail 320 may be connected between at least two upright rails 330. Each end of the handrail 310 may be coupled to the upright rails 330 via the coupling means positioned along the upright rails 330. In one implementation, the ends of the handrail 310 may be coupled at or proximate to top portions of the upright rails 330. The midrail 320 may be similarly connected between two upright rails 330. In one implementation, ends of the midrail 320 may be coupled at or proximate to middle portions of the upright rails 330. The handrail 310 and/or the midrail 320 may be a horizontal ledger or any other implementation known to those skilled in the art.

In addition, a deck 340 may be placed on top of a plurality of horizontal members 205. The deck 340 may be composed of steel, aluminum, wood, plywood, or any other material known to those skilled in the art. In one implementation, the deck 340 may be any walking surface known to those in the art that may be installed on top of the horizontal members 205. In another implementation, the handrail 310 and/or the midrail 320 may be designed to allow for a tie-off point for workers traversing along the deck 340. In this manner, each combination of the scaffold bracket 100, the horizontal member 205, diagonal member 210, and the upright rail 330 may be connected to at least one other such combination in the scaffolding system 300 along with the deck 340 to allow workers to traverse along the wall 40.

Figure 4:
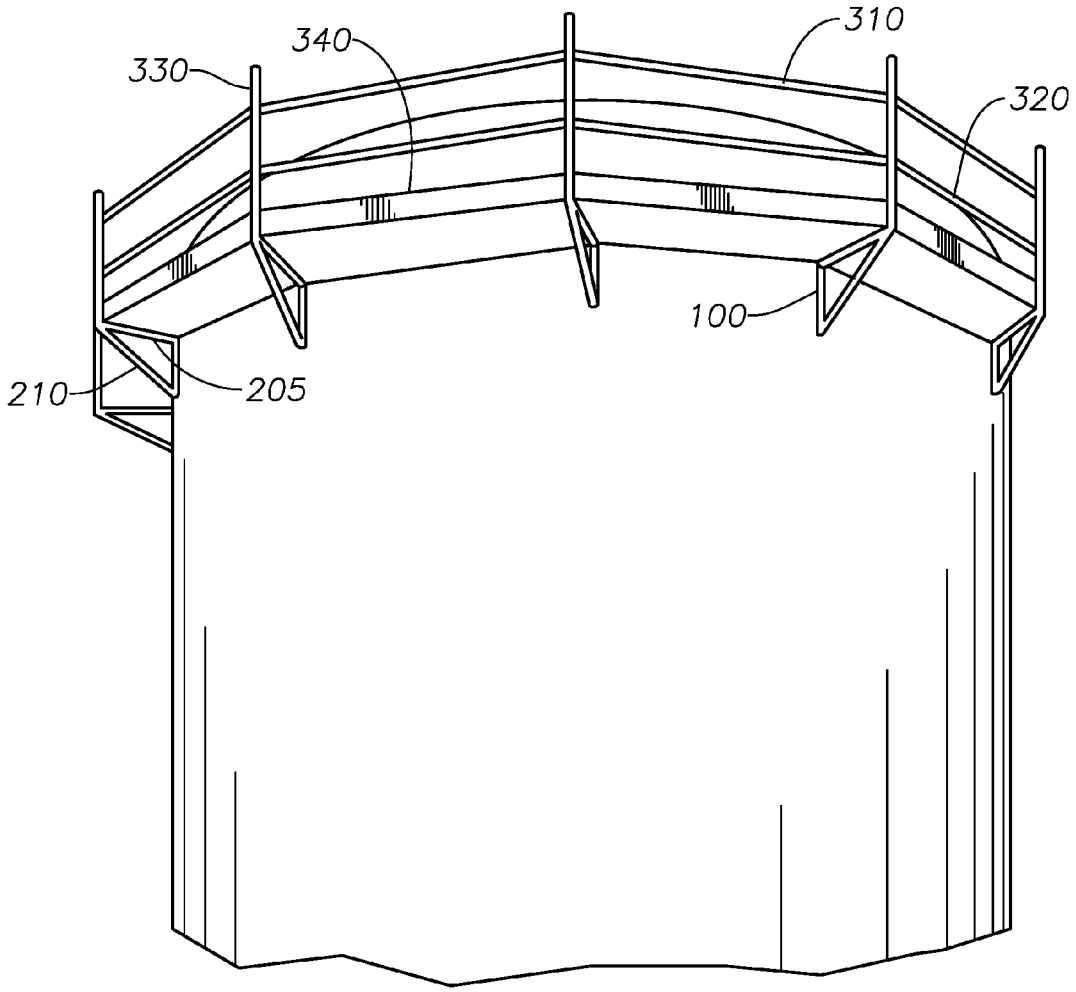
FIG. 4 illustrates a scaffolding system which uses a plurality of scaffold brackets on an above-ground tank, in accordance with implementations of various techniques described herein.

FIG. 4 illustrates a scaffolding system 400 which uses a plurality of scaffold brackets 100 on an above-ground tank in accordance with implementations of various techniques described herein. As shown, a plurality of scaffold brackets 100, horizontal members 205, diagonal members 210, upright rails 330, handrails 310, midrails 320, and decks 340 may be used along the above-ground tank. In one implementation, the scaffolding system 400 may be used along an interior wall of the above-ground tank.

The implementations as disclosed above may allow construction of a more efficient scaffolding system. For instance, as shown in FIG. 4, the scaffold bracket 100 may be attached near a top of an above-ground storage tank, allowing workers to perform duties needed near the top of the tank via the deck 340, without the need of additional scaffold brackets, horizontal members, and diagonal members below the scaffold bracket 100 to provide support. Furthermore, the scaffold brackets 100 may be coupled to the welded brackets in a non-permanent manner, thus allowing easier installation or removal. In addition, the top handrail and the midrail may be used to provide a stable, solid support for workers traversing along the deck. Further, components of the scaffold bracket and the scaffolding system may be composed of engineered scaffolding members.

While the foregoing is directed to implementations of various techniques described herein, other and further implementations may be devised without departing from the basic scope thereof, which may be determined by the claims that follow. Although the subject matter has been described in language specific to structural features and/or methodological acts, it is to be understood that the subject matter defined in the appended claims is not limited to the specific features or acts described above. Rather, the specific features and acts described above are disclosed as example forms of implementing the claims.

What is claimed is:

1. An apparatus, comprising:

a scaffold bracket, comprising:

a mounting bracket comprising a plate having a first face and a second face opposite the first face;

a first scaffolding node attached to the first face; and a second scaffolding node attached to the first face;

a horizontal member coupled to the first scaffolding node via frictional force; and a diagonal member coupled to the second scaffolding node via frictional force, wherein the horizontal member and the diagonal member are connected to one another at a node point;

wherein the first scaffolding node comprises a substantially semicircular first rosette portion configured to couple to the horizontal member, and wherein the second scaffolding node comprises a substantially semicircular second rosette portion configured to couple to the diagonal member.

2. The apparatus of claim 1, wherein the scaffold bracket, the horizontal member, and the diagonal member combine to form a knee-braced cantilevered support.

3. The apparatus of claim 1, wherein the first scaffolding node comprises a first cylindrical tubing portion coupled to the substantially semicircular first rosette portion, and wherein the second scaffolding node comprises a second cylindrical tubing portion coupled to the substantially semicircular second rosette portion.

4. The apparatus of claim 1, wherein the substantially semicircular first rosette portion comprises one or more first cut-outs configured to couple to the horizontal member using a first wedge.

5. The apparatus of claim 1, wherein the substantially semicircular second rosette portion comprises one or more second cut-outs configured to couple to the diagonal member using a second wedge.

6. The apparatus of claim 1, wherein the horizontal member and the diagonal member are engineered scaffolding members.

7. The apparatus of claim 1, wherein the first face and the second face are each substantially flat.

8. The apparatus of claim 1, wherein the mounting bracket comprises:

a prong extending laterally from the second face and configured to couple to a wall bracket attached to a wall; and an offset spacer extending laterally from the second face, wherein the prong and the offset spacer are configured to extend laterally from the second face at substantially the same length.

9. The apparatus of claim 1, wherein the first scaffolding node and the second scaffolding node are substantially vertically aligned.

10. A scaffolding system, comprising:

a plurality of scaffold brackets, wherein each scaffold bracket in the plurality of scaffold brackets comprises:

a mounting bracket having a first face and a second face opposite the first face;

a first scaffolding node attached to the first face; and a second scaffolding node attached to the first face;

a plurality of horizontal members, wherein each horizontal member is coupled to the first scaffolding node via frictional force;

a plurality of diagonal members, wherein each diagonal member is coupled to the second scaffolding node via frictional force and to each horizontal member at a node point;

a plurality of upright rails, each coupled to a node point, wherein the upright rails extend in an upward direction above the plurality of horizontal members and the plurality of diagonal members; and one or more horizontal rails coupled between the plurality of upright rails in a substantially horizontal direction;

wherein the first scaffolding node comprises a substantially semicircular first rosette portion configured to couple to each horizontal member, and wherein the second scaffolding node comprises a substantially semicircular second rosette portion configured to couple to each diagonal member.

11. The scaffolding system of claim 10, wherein the one or more horizontal rails comprise one or more handrails, one or more midrails, one or more horizontal ledgers, or combinations thereof.

12. The scaffolding system of claim 10, further comprising one or more walking surfaces disposed on top of the plurality of horizontal members.

13. The scaffolding system of claim 10, wherein the plurality of horizontal members, the plurality of diagonal members, the plurality of upright rails, and the one or more horizontal rails are engineered scaffolding members.

14. The scaffolding system of claim 10, wherein the mounting bracket comprises a plate, and wherein the first face and the second face are each substantially flat.

15. The scaffolding system of claim 10, wherein the mounting bracket comprises:

a prong extending laterally from the second face and configured to couple to a wall bracket attached to a wall; and an offset spacer extending laterally from the second face, wherein the prong and the offset spacer are configured to extend laterally from the second face at substantially the same length.

16. A scaffold bracket, comprising:

a mounting bracket comprising a plate having a first face and a second face opposite the first face;

a first scaffolding node attached to the first face and configured to be coupled to a horizontal member via frictional force; and a second scaffolding node attached to the first face and configured to be coupled to a diagonal member via frictional force;

wherein the first scaffolding node comprises a substantially semicircular first rosette portion configured to couple to the horizontal member, and wherein the second scaffolding node comprises a substantially semicircular second rosette portion configured to couple to the diagonal member.

17. The apparatus of claim 16, wherein the first scaffolding node comprises a first cylindrical tubing portion coupled to the substantially semicircular first rosette portion, and wherein the second scaffolding node comprises a second cylindrical tubing portion coupled to the substantially semicircular second rosette portion.

18. The apparatus of claim 16, wherein the mounting bracket comprises:

a prong extending laterally from the second face and configured to couple to a wall bracket attached to a wall; and an offset spacer extending laterally from the second face, wherein the prong and the offset spacer are configured to extend laterally from the second face at substantially the same length.

* * * * *